US010819050B2

(12) United States Patent
Tuey et al.

(10) Patent No.: US 10,819,050 B2
(45) Date of Patent: Oct. 27, 2020

(54) ELECTRIC CONNECTION ASSEMBLY WITH OVERBENT SOLDERING PIN

(71) Applicant: TE Connectivity Germany GmbH, Bensheim (DE)

(72) Inventors: Ufuk Tuey, Mannheim (DE); Dirk Dunkel, Bensheim (DE); Dominik Kasper, Dudenhofen (DE); Alexander Baierlein, Dinkelsbuhl (DE); Ulrich Kiefner, Durrwangen (DE); Kai Sellien, Lampertheim (DE); Rolf Jetter, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/202,525

(22) Filed: Nov. 28, 2018

(65) Prior Publication Data

US 2019/0097332 A1 Mar. 28, 2019

Related U.S. Application Data

(63) Continuation of application No. PCT/EP2017/063040, filed on May 30, 2017.

(30) Foreign Application Priority Data

May 31, 2016 (DE) ..... 10 2016 209 493

(51) Int. Cl.
*H01R 12/57* (2011.01)
*H01R 12/72* (2011.01)

(52) U.S. Cl.
CPC ..... *H01R 12/57* (2013.01); *H01R 12/722* (2013.01); *H01R 12/724* (2013.01); *H01R 12/725* (2013.01)

(58) Field of Classification Search
CPC ..... H01R 12/57; H01R 12/722; H01R 12/724
(Continued)

(56) References Cited

U.S. PATENT DOCUMENTS 4,491,376 A * 1/1985 Gladd ..... H01R 12/724 439/33
4,639,056 A * 1/1987 Lindeman ..... H01R 13/405 439/61

(Continued)

FOREIGN PATENT DOCUMENTS

CN 205680819 U 11/2016
JP 1311578 A 12/1989

(Continued)

OTHER PUBLICATIONS

Chinese Second Office Action with English translation, Chinese Patent Application No. 201780033758.7, dated Mar. 9, 2020, 14 pages.

(Continued)

*Primary Examiner* — Alexander Gilman
(74) *Attorney, Agent, or Firm* — Barley Snyder

(57) ABSTRACT

An electric connection assembly for surface mounting on a circuit board comprises a soldering pin. The soldering pin has a starting portion disposed in a housing of the electric connection assembly, a middle portion, and an end portion disposed at an end of the soldering pin opposite the starting portion and contacting the circuit board. The middle portion is bent from the starting portion in a direction toward the housing and the end portion is bent from the middle portion in a direction away from the housing. An acute angle is formed between both the starting portion and the middle portion and between the middle portion and the end portion.

11 Claims, 2 Drawing Sheets

(58) Field of Classification Search
USPC ..... 439/83
See application file for complete search history.

(56) References Cited

U.S. PATENT DOCUMENTS

| | | | | |
|---|---|---|---|---|
| 4,802,859 | A * | 2/1989 | Gouldy | H05K 1/148 439/74 |
| 4,802,860 | A * | 2/1989 | Kikuta | H01R 12/724 439/79 |
| 4,850,902 | A * | 7/1989 | Reed | H01R 12/714 439/676 |
| 4,875,863 | A * | 10/1989 | Reed | H01R 12/714 439/79 |
| 5,779,489 | A * | 7/1998 | Davis | H01R 13/7031 439/79 |
| 6,091,147 | A | 7/2000 | Furuyama | |
| 6,431,917 | B1 * | 8/2002 | Belopolsky | H01R 24/64 439/676 |
| 6,505,402 | B2 * | 1/2003 | Moriwake | H01R 43/16 264/272.11 |
| 6,767,224 | B2 * | 7/2004 | Wu | H01R 24/64 439/374 |
| 6,887,112 | B2 * | 5/2005 | Kuroki | H01R 12/716 439/595 |
| 6,991,472 | B2 * | 1/2006 | Du | H01R 13/2435 439/66 |
| 7,044,752 | B2 * | 5/2006 | Olson | H01R 13/41 439/79 |
| 7,445,469 | B2 * | 11/2008 | Wu | H01R 13/658 439/79 |
| 8,033,870 | B2 * | 10/2011 | Xie | H01R 12/57 439/660 |
| 8,449,338 | B2 * | 5/2013 | Gong | H01R 13/18 439/682 |
| 9,281,597 | B2 * | 3/2016 | Hashiguchi | H01R 13/24 |
| 2004/0063344 | A1 * | 4/2004 | Shin | H01R 13/26 439/74 |
| 2012/0267256 | A1 | 10/2012 | Kindred | |

FOREIGN PATENT DOCUMENTS

| | | | |
|---|---|---|---|
| JP | 10303337 | A | 11/1998 |
| JP | 2002359038 | A | 12/2002 |
| JP | 2012226856 | A | 11/2012 |
| JP | 2015150883 | A | 8/2015 |

OTHER PUBLICATIONS

Japanese Notice of Reasons for Refusal, Patent Application 2018-562180, dated Jan. 14, 2020, 9 pages.
Abstract of JP2002359038, dated Dec. 13, 2002, 1 page.
Abstract of JP2012226856, dated Nov. 15, 2012, 1 page.
Abstract of JP2015150883, dated Aug. 24, 2015, 1 page.
Abstract of CN205680819,dated Nov. 9, 2016, 1 page.
PCT Notification, The International Search Report and The Written Opinion of the International Searching Authority, dated Aug. 25, 2017, 13 pages.
Chinese First Office Action with English translation, Chinese Patent Application No. 201780033758.7. dated Jul. 24, 2019, 16 pages.

* cited by examiner

ELECTRIC CONNECTION ASSEMBLY WITH OVERBENT SOLDERING PIN

CROSS-REFERENCE TO RELATED APPLICATIONS

This application is a continuation of PCT International Application No. PCT/EP 2017/063040, filed on May 30, 2017, which claims priority under 35 U.S.C. § 119 to German Patent Application No. 102016209493.9, filed on May 31, 2016.

FIELD OF THE INVENTION

The present invention relates to an electric connection assembly and, more particularly, to an electric connection assembly having a soldering pin for electrically contacting a circuit board.

BACKGROUND

Electric connection assemblies, for example in the form of surface mounted device (SMD) housings or SMD components, have bent soldering pins connecting an electric device in the SMD housing to a circuit board.

The soldering pins can be classified into two types. In a first type, the soldering pins have an S-shape with a starting portion, a middle portion, and an end portion. An angle smaller than or at most equal to 90° is defined both between the starting portion and the middle portion and between the middle portion and the end portion. A direction of the bendings are opposed; the soldering pin has a convex bending and a concave bending. The S-shape of the soldering pins makes it possible to verify solder joints very easily, but very long soldering pins are required which, due to their shape, significantly enlarge the dimensions of a SMD housing or of a SMD component.

An electric connection assembly 1' according to the prior art is shown in FIG. 1. The electric connection assembly 1' comprises a housing 3 and a soldering pin 5. The soldering pin 5 includes a starting portion 7, a middle portion 9, and an end portion 11. The soldering pin 5 shown in FIG. 1 has an S-shape 5*a* and a material thickness d. An electric device 4 is received in the housing 3 and connected to the starting portion 7 of the soldering pin 5.

The electric connection assembly 1' shown in FIG. 1 includes a supporting element 13 separately mounted on the housing 3 in the embodiment of the electric connection assembly 1' shown in FIG. 1, but which can also be formed by a wall 15 of the housing 3 in other embodiments. The supporting element 13 has a supporting surface 17 which rests on a circuit board 19. As shown in FIG. 1, the supporting surface 17 rests on a contacting side 21 of the circuit board 19 and is below a middle portion 9 of the soldering pin 5 towards the end portion 11.

The end portion 11 of the soldering pin 5 rests with a contacting region 23 on the contacting side 21 of the circuit board 19. The end portion 11 of the soldering pin 5 is disposed on a same plane with the supporting surface 17. FIG. 1 shows the electric connection assembly 1' of the prior art in an unsoldered condition 25; no soldering material is disposed between the contacting region 23 and the contacting side 21 of the circuit board 19.

The housing 3 of the electric connection assembly 1', as shown in FIG. 1, receives the starting portion 7 of the soldering pin 5 in a receiving aperture 27 which has lead-in bevels 29. An assembly end 31 of the soldering pin 5 likewise has lead-in bevels 29. The lead-in bevels 29 of the housing 3 and of the soldering pin 5 facilitate insertion of the starting portion 7 into the receiving aperture 27 of the housing 3.

As shown in FIG. 1, a first bending portion 33 of the soldering pin 5 is disposed between the starting portion 7 and the middle portion 9. The first bending portion 33 is defined by a bending radius 35 and by a first deflection angle 37*a*. A second bending portion 39 is disposed between the middle portion 9 and the end portion 11 and, like the first bending portion 33, is defined by a bending radius 35 and by a second deflection angle 37*b*. The first deflection angle 37*a* is different from the second deflection angle 37*b*.

An excess length 43 of the soldering pin 5 is measured from a side face 41 of the housing 3 as shown in FIG. 1. The excess length 43 of the soldering pin 5 corresponds to a length L by which the housing length L0 is enlarged as a result of the insertion of the soldering pin 5 into the housing 3. An inspection direction 45 shown in FIG. 1 is a direction along which, for example, an electrical connection 49, such as a solder joint 51, can be observed or examined by a camera 47.

Another form of soldering pins 5 has a J-shape 5*b* shown in FIG. 2 with starting 7, middle 9, and end portions 11. An angle of 90° is defined both between the starting portion 7 and the middle portion 9 and between the middle portion 9 and the end portion 11. In the J-shape, the direction of the bendings is identical; the soldering pin has two convex or two concave bendings, so that the starting portion and the end portion substantially point in the same direction.

An electric connection assembly 1" according to another embodiment of the prior art is shown in FIG. 2 in the unsoldered condition 25. The soldering pin 5 of the electric connection assembly 1" in FIG. 2 has a J-shape 5*b*. The J-shape 5*b* of the soldering pin 5 has a first deflection angle 37*a* which substantially corresponds to a right angle 37*c*. The J-shape 5*b* of the soldering pin 5 has a larger first deflection angle 37*a* than the S-shape 5*a* shown in FIG. 1. The embodiment of the soldering pin 5 shown in FIG. 1 has a first deflection angle 37*a* of approx. 80°.

The second deflection angle 37*b* of the J-shape 5*b* shown in FIG. 2, disposed between the middle portion 9 and the end portion 11, is an obtuse angle 37*d*. If the respective first deflection angle 37*a* and the respective second deflection angle 37*b* of FIGS. 1 and 2 are compared, the direction of the angle measurement of the first deflection angle 37*a* is opposite to the direction of the angle measurement of the second deflection angle 37*b* in the S-shape 5*a*, whereas in the J-shape 5*b*, the direction of the angle measurement of the first deflection angle 37*a* corresponds to that of the second deflection angle 37*b*. The middle section 9 is bent in the clockwise direction from the starting portion 7 both in the S-shape 5*a* and in the J-shape 5*b*. The end portion 11 of the S-shape 5*a* is, however, bent counter-clockwise, while the end portion 11 of the J-shape 5*b* is again bent in the clockwise direction with respect to the respective middle portion 9.

The end portion 11 of the J-shape 5*b*, as shown in FIG. 2, has a contacting region 23 extending in the direction of the circuit board 19. If the contacting region 23 of the end portion 11 of the J-shape 5*b* is electrically connected to the circuit board 19, the electrical connection 49 formed, such as the solder joint 51, cannot be viewed by a camera 47 along the inspection direction 45, since said solder joint 51 is located under the housing 3 or in a pocket 53 of the housing 3.

The excess length 43 of the J-shape 5*b* of the soldering pin 5 is significantly reduced compared with the excess length 43 of the S-shape 5*a* of the soldering pin 5 shown in FIG. 1. The advantage of the J-shape 5*b* of soldering pins 5 is thus that shorter soldering pins can be used and the SMD housings 3 or SMD components can have smaller geometric dimensions. However, the disadvantage of the J-shape 5*b* is the difficulty of verifying the solder joints 51, because these are substantially located between the SMD housing 3 or the SMD component and the circuit board 19 and are difficult to view and verify visually. Even on observing the electrical connection 49 along an inclined inspection direction 45*a*, the electrical connection 49 is at least partially concealed by the soldering pin 5.

SUMMARY

An electric connection assembly for surface mounting on a circuit board comprises a soldering pin. The soldering pin has a starting portion disposed in a housing of the electric connection assembly, a middle portion, and an end portion disposed at an end of the soldering pin opposite the starting portion and contacting the circuit board. The middle portion is bent from the starting portion in a direction toward the housing and the end portion is bent from the middle portion in a direction away from the housing. An acute angle is formed between both the starting portion and the middle portion and between the middle portion and the end portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
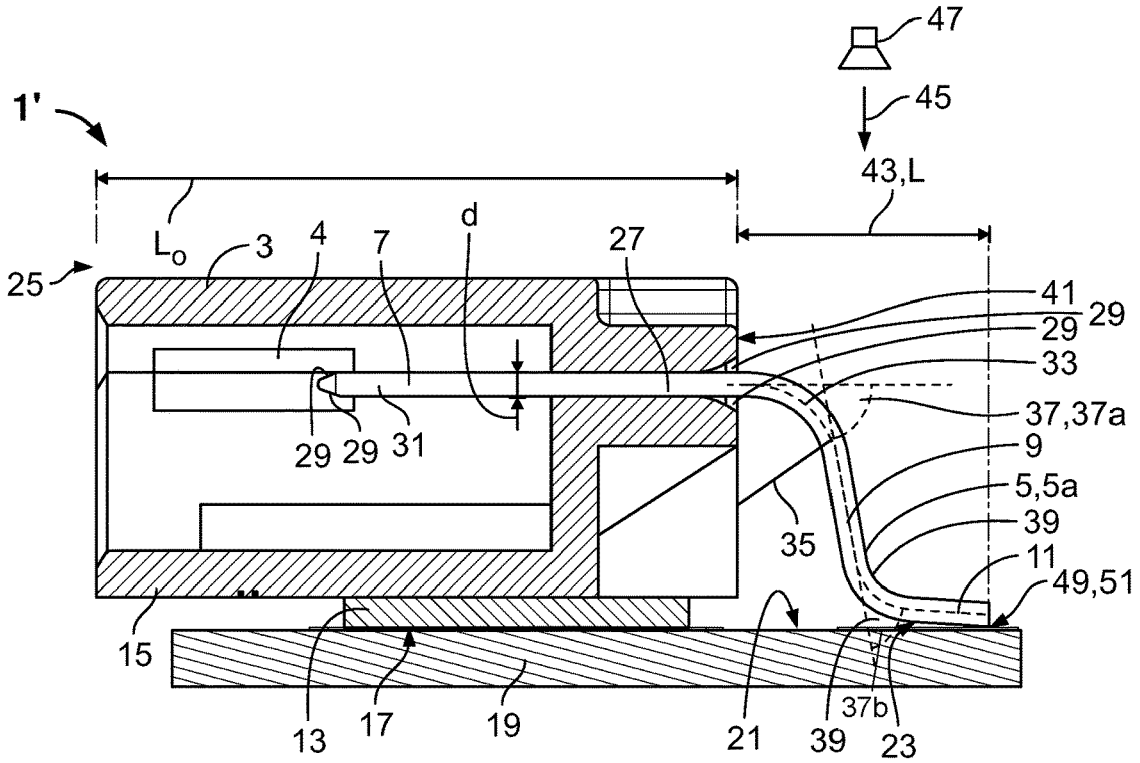
Fig. 1 PRIOR ART
FIG. 1 is a sectional side view of an electric connection assembly according to the prior art.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 3:
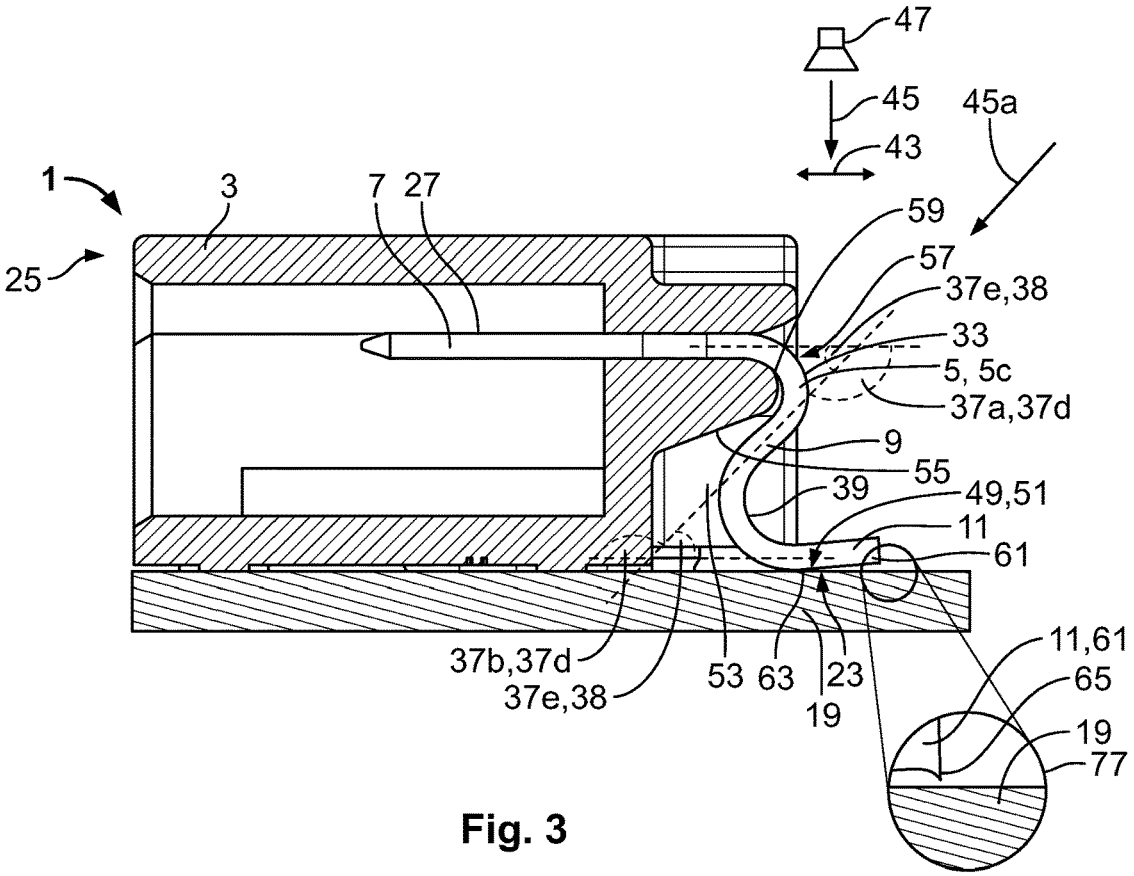
FIG. 3 is a sectional side view of an electric connection assembly according to an embodiment.
Figure 4:
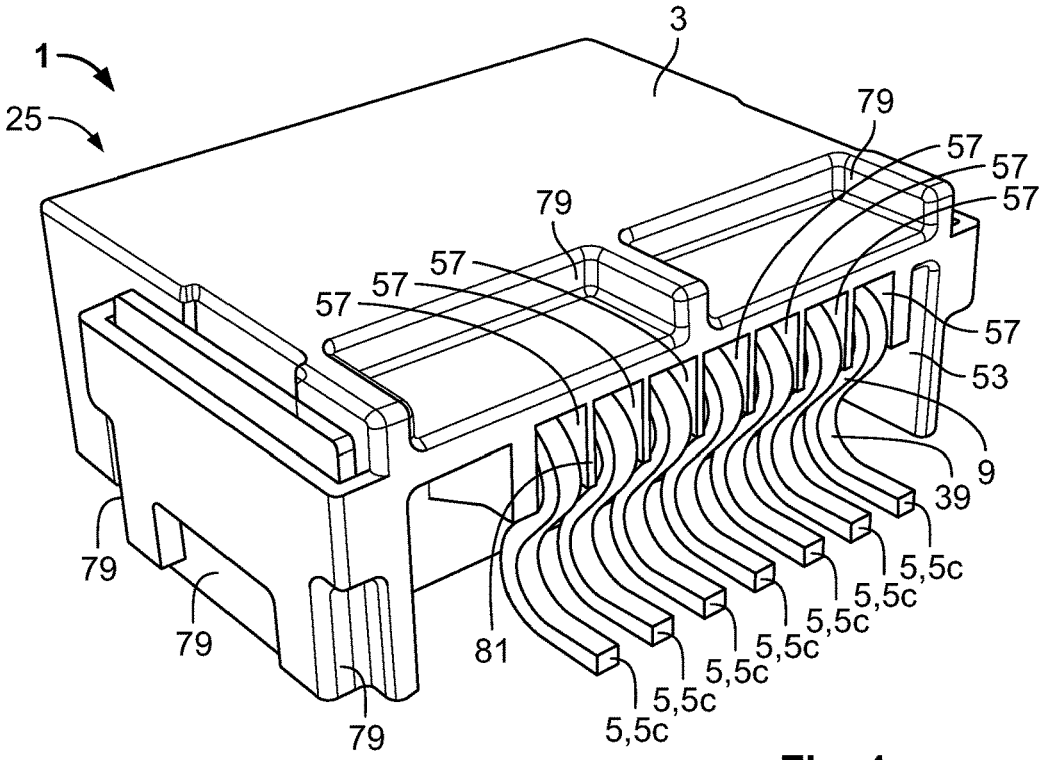
FIG. 4 is a perspective view of the electric connection assembly of FIG. 3.

An electric connection assembly 1 according to an embodiment of the invention is shown in FIGS. 3 and 4. The electric connection assembly 1 is shown in the unsoldered condition 1 in FIGS. 3 and 4.

Figure 2:
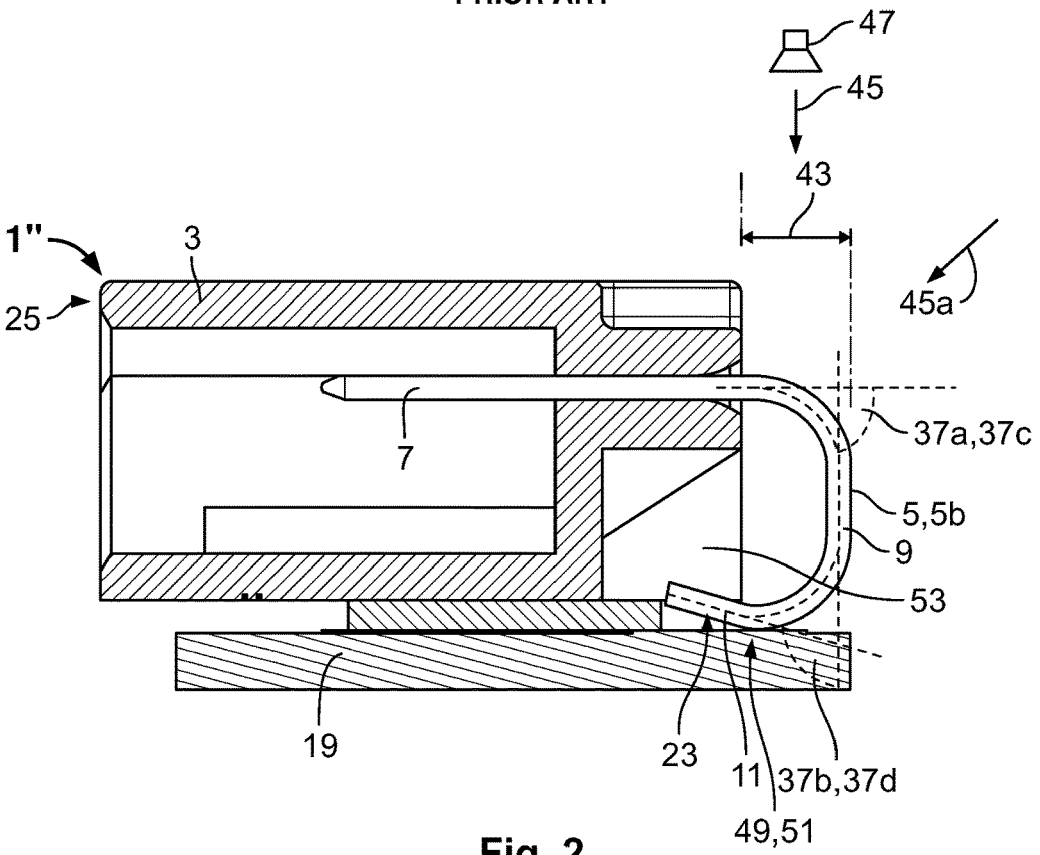
Fig. 2 PRIOR ART
FIG. 2 is a sectional side view of another electric connection assembly according to the prior art.

The housing 3 of the electric connection assembly 1 differs from the housings 3 shown in FIGS. 1 and 2. The pocket 53 of the housing 3 shown in FIG. 3 has an inclined pocket inner side 55. The first bending portion 33 of the soldering pin 5 has at least a section abutting the inclined pocket inner side 55, but detaches from this at the transition of the first bending portion 33 into the middle portion 9. In the shown embodiment, the soldering pin 5 has a rectangular cross-section.

The middle portion 9 and the second bending portion 39 of the soldering pin 5 shown in FIG. 3 are completely received in the pocket 53. The soldering pin 5 of FIG. 3 has a Z-shape 5*c*. Both the first deflection angle 37*a* and the second deflection angle 37*b* of the Z-shape 5*c* are obtuse angles 37*d*, so that complementary angles 37*e* between the starting portion 7 and the middle portion 9 and between the middle portion 9 and the end portion 11 are acute angles 38. In an embodiment, each of the obtuse angles 37*d* is approximately 130°. The bending radius 35 of at least one of the first bending portion 33 and the second bending portion 39 is greater than twice the material thickness d of the soldering pin 5.

As shown in FIG. 3, the middle portion 9 is bent from the starting portion 7 in a direction toward the housing 3 and the end portion 11 is bent from the middle portion 9 in a direction away from the housing 3. The end portion 11 protrudes from the pocket 53 and projects beyond the starting portion 7 and the first bending portion 33 in a direction parallel to the starting portion 7. The acute angle 38 between the starting portion 7 and the middle portion 11 is smaller than the acute angle 38 between the middle portion 9 and the end portion 11. The acute angle 38 between the starting portion 7 and the middle portion 9 opens towards the housing 3, and the acute angle 38 between the middle portion 9 and the end portion 11 opens away from the housing 3. In an embodiment, the end portion 11 is parallel to the starting portion 7 and the first bending portion 33 and the second bending portion 39 are in a same plane as the starting portion 7, the middle portion 9, and the end portion 11.

As shown in FIG. 3, the first bending portion 33 is partially located in a transition recess 57 which connects the receiving aperture 27 to the pocket 53. The transition recess 57 is delimited in the direction of the starting portion 7 by a convex supporting or stopping surface 59, which the first bending portion 33 abuts at least in sections. FIG. 3 shows that the first bending portion 33 turns into the second bending portion 39 with no straight section in between so that the middle portion 9 simply consists of the two bending portions 33, 39.

The end portion 11, as shown in FIG. 3, has a free end 61 which is bent in the direction of the starting portion 7 and away from the circuit board 19. The end portion 11 thus contacts the circuit board 19 at a defined contact point 63 and not with a possible burr 65 which may occur at the free end 61 as a result of cutting the soldering pin 5 to size, as shown in enlargement 77 in FIG. 3. The free end 61 of the end portion 11 which is bent in the direction of the starting portion 7 can result from the second bending portion 39 or can be produced by a third bending portion. A straight portion of the end portion 11 can be located between the possible third bending portion and the second bending portion 39. The bending radius of the bent free end 61 can be greater than the bending radius 35 of the first bending portion 33 and/or the second bending portion 39.

The soldering pin 5 is soldered onto a surface of the circuit board 19 at the contact point 63 by surface mounting or SMD mounting. In an embodiment, the end portion 11 is tin plated to facilitate soldering. In an embodiment, less than 50% of the contact point 63 is received in the pocket 53 of the housing 3. If heat is applied to the soldering pin 5 and the soldering pin 5 undergoes linear expansion, the position of the electric connection assembly 1 with respect to a plane of the circuit board 19 will not change. The electric connection assembly 1 may be slightly raised from the circuit board 19 but will not be laterally displaced parallel to the circuit board 19.

The contacting region 23 of the Z-shape 5*c* of the soldering pin 5 protrudes from the pocket 53 so that the electrical connection 49, such as the solder joint 51, can easily be viewed and also examined with the aid of the camera 47 along the inspection direction 45. The contacting region 23 can constitute part of the end portion 11 or can extend over an entirety of the end portion 11. The excess length 43 of the soldering pin 5 of the Z-shape 5*c* is considerably smaller than the excess length 43 of the S-shape 5*a* of the soldering pin 5 shown in FIG. 1 and corresponds approximately to the excess length 43 of the J-shape 5*b* of the soldering pin 5 shown in FIG. 2. In order to be able to assess the quality of a solder joint 51, it is necessary to be able to view 50% of said solder joint 51. This can still be achieved with the electric connection assembly 1 shown in FIG. 3, even if the contacting region 23 is located partially within the pocket 53. If it is possible to use an inclined inspection direction 45*a*, the complete solder joint 51 can still be viewed even if it is located largely in the pocket 53. The possibility of verifying solder joints 51 makes it possible to carry out an effective and simple quality control and to optimize processes, which can likewise result in a reduction in costs.

The electric connection assembly 1 is shown in the unsoldered condition 25 and without a circuit board 19 in FIG. 4. As shown in FIG. 4, the housing 3 has recesses 79 and the electric connection assembly, in the shown embodiment, has seven soldering pins 5 in a Z-shape 5*c*. The middle portion 9 of the Z-shape 5*c* and the second bending portion 39 of the Z-shape 5*c* are received in the pocket 53. The pocket 53 of the electric connection assembly 1 is configured such that all seven soldering pins 5 are each partially received in the pocket 53. In order to prevent a mechanical and an electric contact of the individual soldering pins 5 with one another, each of the seven soldering pins 5 has a corresponding transition recess 57. The transition recesses 57 are each separated from one another by a separating wall 81.

What is claimed is:

1. An electric connection assembly for surface mounting on a circuit board, comprising:

a soldering pin having a starting portion disposed in a housing of the electric connection assembly, a middle portion, and an end portion disposed at an end of the soldering pin opposite the starting portion and contacting the circuit board, the middle portion is bent from the starting portion in a direction toward the housing and the end portion is bent from the middle portion in a direction away from the housing, an acute angle is formed between both the starting portion and the middle portion and between the middle portion and the end portion, the housing has a pocket receiving at least a portion of the soldering pin, the pocket is open in a direction toward the circuit board, the end portion has a contacting region forming an electrical connection with the circuit board, at least a portion of the contacting region is located in the pocket.

2. The electric connection assembly of claim 1, wherein the end portion extends beyond the starting portion in a direction parallel to the starting portion.

3. The electric connection assembly of claim 1, wherein a first bending portion is disposed between the starting portion and the middle portion and a second bending portion is disposed between the middle portion and the end portion, the first bending portion turns into the second bending portion with no straight section between the first bending portion and the second bending portion.

4. The electric connection assembly of claim 3, wherein a bending radius of at least one of the first bending portion and the second bending portion is greater than twice a material thickness of the soldering pin.

5. The electric connection assembly of claim 1, wherein the end portion is bent in a direction toward the starting portion.

6. The electric connection assembly of claim 1, wherein the housing has a supporting surface and the end portion of the soldering pin is disposed on a same plane with the supporting surface.

7. The electric connection assembly of claim 1, wherein a transition between the middle portion and the end portion of the soldering pin extends into the pocket.

8. The electric connection assembly of claim 7, wherein the housing has a transition recess connecting the pocket and a receiving aperture in which the soldering pin is received in the housing.

9. The electric connection assembly of claim 8, wherein a portion of the soldering pin between the starting portion and the middle portion is received in the transition recess.

10. The electric connection assembly of claim 1, further comprising an electric device connected to the starting portion of the soldering pin.

11. The electric connection assembly of claim 1, wherein an entirety of the pocket is open in the direction toward the circuit board.

* * * * *